US005616983A

United States Patent [19]

Beckwith et al.

[11] Patent Number: 5,616,983

[45] Date of Patent: Apr. 1, 1997

[54] ELECTRODE ASSEMBLY WITH LEAD WIRE ATTACHMENT

[75] Inventors: Timothy A. Beckwith; William M. Brintz, both of Coon Rapids; Walter A. Barniskis, New Hope, all of Minn.

[73] Assignee: Honeywell Inc., Minneapolis, Minn.

[21] Appl. No.: 395,354

[22] Filed: Feb. 28, 1995

[51] Int. Cl.[6] ..... H01R 4/00

[52] U.S. Cl. ..... 313/51; 313/49; 313/575; 313/631; 313/311; 439/883; 439/860; 445/23

[58] Field of Search ..... 439/883, 860; 313/51, 49, 574, 575, 631, 632, 311, 326, 318.03, 318.09, 318.12; 445/23, 35, 46; 372/87, 65

[56] References Cited

U.S. PATENT DOCUMENTS 3,861,780 1/1975 Hobbs, II ..... 439/883

5,163,065 11/1992 Ford ..... 313/633

5,168,504 12/1992 Ford ..... 313/633

OTHER PUBLICATIONS

F.V. Legge, IBM Technical Disclosure Bulletin, vol. 12, No. 7, Dec. 1969.

*Primary Examiner*—Nimeshkumar D. Patel

*Attorney, Agent, or Firm*—Charles J. Ungemach

[57] ABSTRACT

Disclosed is an electrode assembly particularly for electrodes in which the electrode consists of a material which is non-conducive to soldering of an electrical wire thereto. A retaining wing is forcibly fitted on an electrode having a closed circumferential wall member. An electrical wire is attached to the ring member which consists of a weldable or solderable material.

11 Claims, 1 Drawing Sheet

ELECTRODE ASSEMBLY WITH LEAD WIRE ATTACHMENT

BACKGROUND OF THE INVENTION

1. Field of the Invention

The present invention is related to electrode assemblies, and particularly electrode assemblies in which the electrode consists of a material which is non-conducive to soldering of an electrical wire thereto.

2. Description of the Related Art

Gas discharge devices, for example, lasers, require at least a pair of electrodes affixed to a chamber for containing a lazing gas. Electrical wires are attached to the electrodes. A high voltage power supply is electrically connected to the electrodes through the electrical wires for ionizing the lazing gas, and subsequent generation of laser beams.

The material chosen for the electrode will impact the operating life of the laser, and in some circumstances, the shelf life of the laser. Aluminum has been frequently selected as the electrode material for its excellent electrical characteristics, particularly when employed as a cathode.

Recently, beryllium-based electrodes used for a cathode have been shown to have excellent electrode properties. Beryllium-based electrodes include beryllium oxide materials and the like, and have been described in U.S. Pat. Nos. 5,163,065 and 5,168,504, issued in the name of Carol M. Ford.

Although beryllium is an excellent electrode material, the material is considered a highly toxic carcinogenic material. That is, under certain circumstances, it may cause berylliosis, i.e., may cause some forms of lung disease. As such, minimal handling of these materials is necessary to avoid the aforementioned deleterious consequences.

Further, beryllium is a material having a very low soderability property, and is also non-conducive to welding. These properties of beryllium make it difficult to process a reliable attachment of an electrical wire thereto. In order to overcome the above-stated deficiencies, an electrically conductive cement is sometimes employed for affixing an electrical wire in electrical contact with a beryllium electrode.

SUMMARY OF THE INVENTION

An object of the present invention is to provide a method for affixing an electrical wire in electrical contact with a electrode which consists of a material which is non-conducive to welding or soldering.

Another object of the present invention is to provide a method for affixing an electrical wire in electrical contact with a electrode which consists of a material which is highly toxic and where other methods of attachment of an electrical wire thereto may cause workplace risk.

In the present invention, an electrode assembly comprises an electrode having a closed circumferential outer wall member. An electrically conductive ring member is employed to exert a frictional force radially against and in contact with peripheral portions of the circumferential outer wall member of the electrode. The electrically conductive ring member consists of a material which is soderable for permitting an electrical wire to be affixed to and in electrical contact with the ring member by soldering or welding, or the like.

DESCRIPTION OF THE PREFERRED EMBODIMENT

Figure 1:
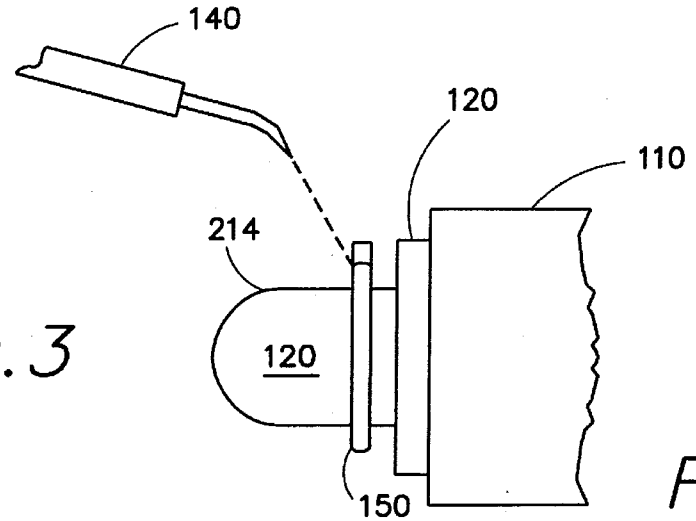
FIG. 1 is a plan view of the electrode assembly in accordance with the present invention.
Figure 2:
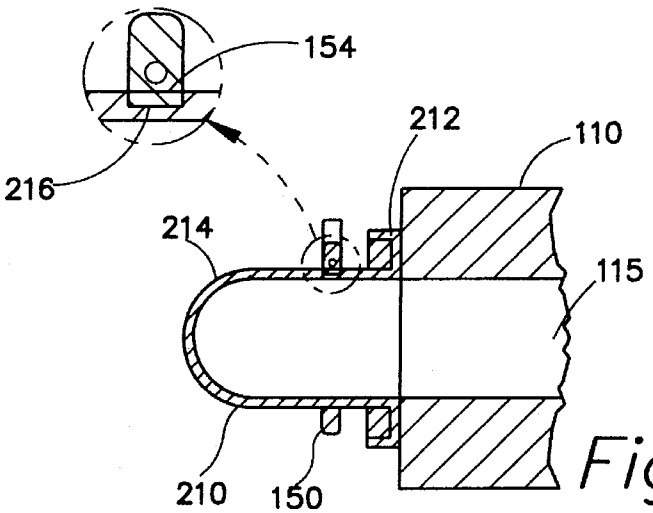
FIG. 2 is a cross-sectional view of FIG. 1.
Figure 3:
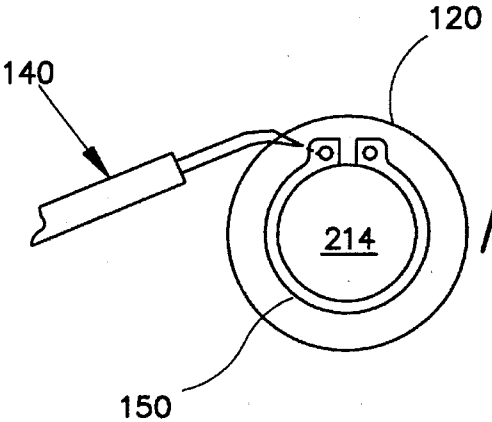
FIG. 3 is another plan view of the electrode assembly of FIG. 1.

Illustrated in the partial plan views of FIGS. 1 and 3, and the corresponding cross sectional view of FIG. 2 is an electrode assembly in accordance with the present invention. Thereshown is a portion of a block 110 having chamber 115 for containing a gas and forms in part a gas discharge device such as a laser. Electrode 120 is illustrated affixed to block 120 by a variety of techniques including but not limited to an indium seal, or the like.

Electrode 120 is illustrated as being somewhat thimble shaped and includes a closed circumferential wall member 210, domed shaped end member 214, and opened end 212 thereby allowing the electrode to be in contact with the gas contained in block 110. Closed circumferential wall member 210 further includes a circumferential groove 216, therein.

As further illustrated in the drawings, a ring member 150, sometimes referred to as a snap-ring, is forcibly placed over the dome of electrode 120 until ring member 150 seats in groove 216 such that the inner shoulder 154 of snap ring 150 exerts a frictional force radially against the circumferential wall member 210 and is in electrical contact with electrode 120.

Ring member 150 is illustrated as an "open end" ring member and may be provided by a wide variety of available retaining rings or snap rings having varying shape and characteristics, particularly having good solderable and/or weldable properties. For example, Model 510-43 retaining rings manufactured by Waldes Kohinoor, Inc., under the trademark WALDES TRUARC have characteristics which achieve the intended function. More specifically, Model 510-43 retaining rings consisting of a Beryllium-Copper alloy are particularly suited for being placed in contact with Beryllium-based electrodes.

Figure 4:
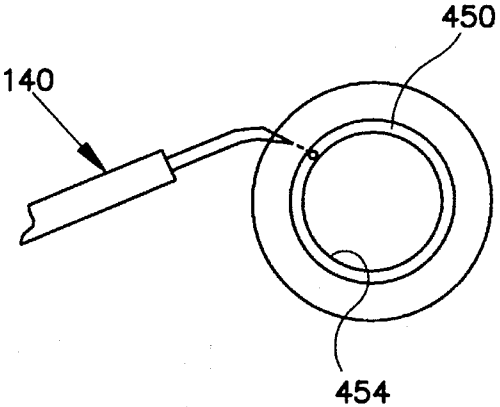
FIG. 4 is a plan view of another embodiment of the present invention.

An alternate arrangement of the present invention is illustrated in FIG. 4 where a closed ring member 450 such as a press fit ring is employed. In this situation, the electrode no longer employs groove 216. Ring 450 is forcibly place over the top of the electrode until a strong radial friction force is applied by inner shoulder 454 of ring member 450 against the circumferential outer wall member of electrode 120.

As illustrated in the Figures electrical wire 140 is affixed to the ring member by soldering or welding in well known manner, since the ring member is chosen to have good solderable or weldable properties.

The electrode assembly of the present invention is particularly applicable to highly toxic or non-solderable electrode materials. Although the electrode configuration illustrated in the drawings is particularly cylindrical in form, the electrode configuration is not intended to limit the scope of the present invention. For example, the electrode may also be a tapered or conical configuration, all of which are envisioned to be within in the true spirit and scope of the present invention.

The embodiments of an invention in which an exclusive property or right is claimed are defined as follows:

1. An electrode assembly comprising:

an electrode consisting of an electrically conductive material and having a closed circumferential outer wall member surrounding, at least in part, a reference axes;

an electrically conductive ring member having an inner shoulder surrounding, at least in part, said circumferential outer wall member, and said inner shoulder exerting a frictional force radially against and in electrical contact with peripheral portions of said circumferential outerwall member of said electrode; and an electrical wire affixed to and in electrical contact with said ring member.

2. The electrode assembly of claim 1 wherein said electrode includes a circumferential groove in said circumferential outer wall member of said electrode, and where said inner shoulder of said ring member is configured to seat within said circular groove and exert said frictional force radially against and in contact with circumferential wall portions of said groove.

3. The electrode assembly of claim 2 wherein said ring member is an open ring having an aperture adapted to be spread diametrically opened for permitting said ring member to be forced into said groove.

4. The electrode assembly of claim I wherein said ring member is a closed ring having an aperture smaller than the periphery formed by said closed circumferential wall member.

5. The apparatus of claim 1 wherein said electrode is thimble shaped.

6. The apparatus of claim 1 wherein said electrode consists of a material haveing a low solderability property.

7. The apparatus of claim 1 wherein said electrode consists of beryllium.

8. The apparatus of claim 1 wherein said ring member is a press fit ring.

9. The apparatus of claim 2 wherein said ring member is a open-end mechanical retaining ring.

10. A method of placing an electrical wire in electrical contact with a thimble-shaped electrode comprising the steps of:

forming a circumferential groove in a closed circumferential wall member which forms, in part, said thimble shaped electrode;

affixing an electrical wire in electrical contact with a ring member; and forcing a ring member into said groove to seat therein such that an inner shoulder of said ring member exerts a frictional force radially against and in contact with peripheral portions of said closed circumferential wall member which forms, in part said groove.

11. A method of placing an electrical wire in electrical contact with a thimble-shaped electrode comprising the steps of:

affixing an electrical wire in electrical contact with a ring member; and forcing a ring member in an axial direction onto said thimble-shaped electrode such that an inner shoulder of said ring member exerts a frictional force radially against and in contact with peripheral portions of a closed circumferential wall member which forms, in part said thimble-shaped electrode.

* * * * *